United States Patent [19]

Laroche

[11] 4,109,893

[45] Aug. 29, 1978

[54] FORM PANEL SPACING DEVICE

[76] Inventor: Jean Pierre Laroche, Mazion, Saint-Paul, (Gironde), France

[21] Appl. No.: 706,205

[22] Filed: Jul. 19, 1976

[30] Foreign Application Priority Data

Jul. 22, 1975 [FR] France ..... 75 22883
Dec. 4, 1975 [FR] France ..... 75 37168

[51] Int. Cl.[2] ..... E04G 17/06
[52] U.S. Cl. ..... 249/175; 249/43; 249/217
[58] Field of Search ..... 249/40–46, 249/190–191, 213–218, 175

[56] References Cited

U.S. PATENT DOCUMENTS

| | | | |
|---|---|---|---|
| 1,850,402 | 3/1932 | Lampert | 249/42 |
| 2,502,672 | 4/1950 | Roother | 249/42 |
| 3,514,070 | 5/1970 | McArdle | 249/40 |
| 3,648,961 | 3/1972 | Farrow | 249/43 |
| 3,785,610 | 1/1974 | Dagiel | 249/214 |

FOREIGN PATENT DOCUMENTS

| | | | |
|---|---|---|---|
| 1,198,134 | 12/1959 | France | 249/43 |

*Primary Examiner*—Francis S. Husar
*Assistant Examiner*—John McQuade
*Attorney, Agent, or Firm*—Mason, Fenwick & Lawrence

[57] ABSTRACT

A device for ensuring the spacing of form panels during the pouring of concrete walls including a spacing cone in the shape of a frustum of a cone provided with a wear resisting flange moulded around the larger base.

4 Claims, 6 Drawing Figures

FORM PANEL SPACING DEVICE

This invention relates to a device for maintaining desired spacing of form panels during the pouring of concrete walls.

In casting concrete walls, a form composed of panels often made from metal, wood or the like are positioned in the desired location. To maintain spacing between these panels, panel spacing cones are used to separate the panels. These cones are in fact frustums, but they will be called cones hereinafter, so as to comply with the terminology of the building art.

The presently known cones are generally made from a plastic material. However, so that their price remains reasonable, each cone must contain the smallest possible volume of plastic. Nevertheless, it must at the same time be robust and have smooth surfaces which only slightly adhere to the concrete. To decrease the cost of said cones, most of the hitherto existing cones have a conical central hole. In this case, the centering of the cone on the threaded rod during assembly is difficult.

Moreover, when it is desired to extract these cones, they are generally struck with any appropriate tool on the conventional small base thereof. This operating procedure results in the cones falling to the ground, with the consequent risk of breakage, accidents or loss. In addition, it is obviously desirable to be able to reuse the cones several times. It is necessary for the edges to remain clean and undercut areas will form which increase the hooking of the cones in the concrete wall, making their extraction even more difficult.

A further disadvantage of the known panel spacing cones is that the plastic material is very sensitive to shocks and offers little resistance to wear, particularly at the edges. When the edge of the large base is worn, it becomes difficult to expel the cone from the concrete.

Furthermore, at the time of removing the panels when the concrete has set, it is necessary to seal the holes left by the panel spacing cones. These holes are difficult to seal by conventional means. It is necessary to have personnel who have been specially trained in finishing work. Moreover, this sealing work takes a long time to perform and the quality of the seal obtained is often inadequate. Thus, in summarizing, the conventional solutions are relatively unsatisfactory and very time-consuming.

The object of the present invention is to obviate the above disadvantages and proposes a device for ensuring the spacing of panels during the pouring of concrete walls, which is simple, cheap and easy to install and remove. It also proposes to solve in advantageous manner the problems caused by the sealing of holes left by panel spacing cones.

To this end, the invention relates to a device for ensuring the spacing of panels during the pouring of concrete walls including, a frustum having a wear-resisting flange, molded about its large base.

This flange makes it possible to reuse the cone several times, in that it can be removed from its location without being held back by a fin.

According to another feature of the invention, the device is made from plastic material.

According to another feature of the invention, the two bases of the cone are not planar. Each of them is formed by a very flat cone, whose point is turned towards the inside of the panel spacing cone.

As a result of this feature, a slight crushing of the plastic material at the two ends of the cone is possible during tightening. The system is then tight and cannot fill with cement slurry.

According to another feature of the invention, the device is hollow and the inner walls are provided with ribs permitting its centering on a clamping rod, during the positioning between the panels.

As a result of these ribs, the cone axis can coinside or be parallel with the threaded rod axis, which increases the rigidity of the cone during tightening.

According to another feature of the invention, the ribs are interrupted at a short distance from the large end of the cone, in order to permit the engagement of an extracting tool, no matter what the length of the cone.

In order not to reduce the stability of the cone only every alternate rib can be interrupted over a length of about 15 mm. This arrangement makes it possible to provide a support for a tearing away tool. This tool is introduced between the ribs of the cone until the latter are interrupted. The tool is then rotated so as to bring it in front of the rib, followed by pulling in order to separate and extract the cone.

Moreover, in order to obtain panel spacings greater than those permitted by the use of a single cone, it is possible to fit end to end two plastic cones, whereby the small ends of the two cones face one another. In this case, it is impossible to strike against the small ends of the cone in order to withdraw the same. In the same way, it is also frequently necessary to have to place the small end on the inaccessible face of a wall — even in the case of a single cone.

According to another feature of the invention, a wear-preventing flange is moulded around the large face of each cone.

A tool for extracting the cones may include a rod having at one end an extraction head carrying cutout whose shape is complementary to that of the ribs of the cone and at the other end an abutment. A tube having a handle slides along the rod. Movement of the tube along the rod is limited by the abutment and the weight of the handle is sufficient to extract the cone when the tube impacts the abutment.

The rod may include two diametrically opposite pins which strike against the ribs when the extraction head is rotated to the desired position relative to the cone.

This arrangement makes it possible to extract the cones very easily, without danger and without risk of loss or breakage, because the cones no longer fall to the ground after extraction.

In order to be able to use the extractor with one hand, the extraction head and the rod to which it is fixed must not be able to rotate relative to the handle. Thus, the rod and the tube which slides thereon have a cross-section which is other than cylindrical. This section can be square, triangular or the like.

According to another feature of the invention, the handle has a stop which limits the displacement of the rod during the introduction of the apparatus into the cone.

When the extraction head is introduced between the ribs, and then following the rotation thereof in order to make it face the ribs, the heavy handle is put into use, which, under the impulse of the shock on striking against the abutment fixed to the rod, detaches the cone from the concrete and moves it away. This arrangement limits damage to the edges of the large ends of the cones, which can then be recovered on the extractor instead of falling freely to the ground, as is in the case when they are removed by striking with a mallet on the small end.

A conical frustum shaped concrete plug serves to seal the holes left in the walls at the time of removing spacing cones. The dimensions of the concrete plug are slightly less than those of the hole which must be sealed. Adjacent the small base of the member, the angle of the cone is approximately double that of the remainder of the cone. The outer surface of the cone may have ridges, cavities or grooves. The conical plug may be mass produced at a very advantageous price compared with the conventional method.

A process for fitting a concrete plug to seal the holes left in the walls at the time of removing the spacing cones would include placing a coating in the hole to be sealed. The concrete plug is introduced into the hole by its small base and rotated in order to uniformly distribute the coating over the cone walls with the plug being driven in by means of a hammer. The increased cone angle at the end of the cone prevents the cone from displacing the coating towards the bottom of the hole, which would result in pool sealing and bonding of the plug in the hole. Moreover, the walls of the holes are generally very smooth and, therefore, depressions on the surface of the conical member ensure a better distribution of the coating along the walls of the hole. The sealing product may be placed around the small base of the concrete member to ensure sealing of the assembly. This process can be performed without using specially treated manpower and the speed of assembly, compared with all known solutions, increases the profitability of the process tenfold.

The present invention will be better understood by referring to the attached drawings, wherein.

Figure 1:
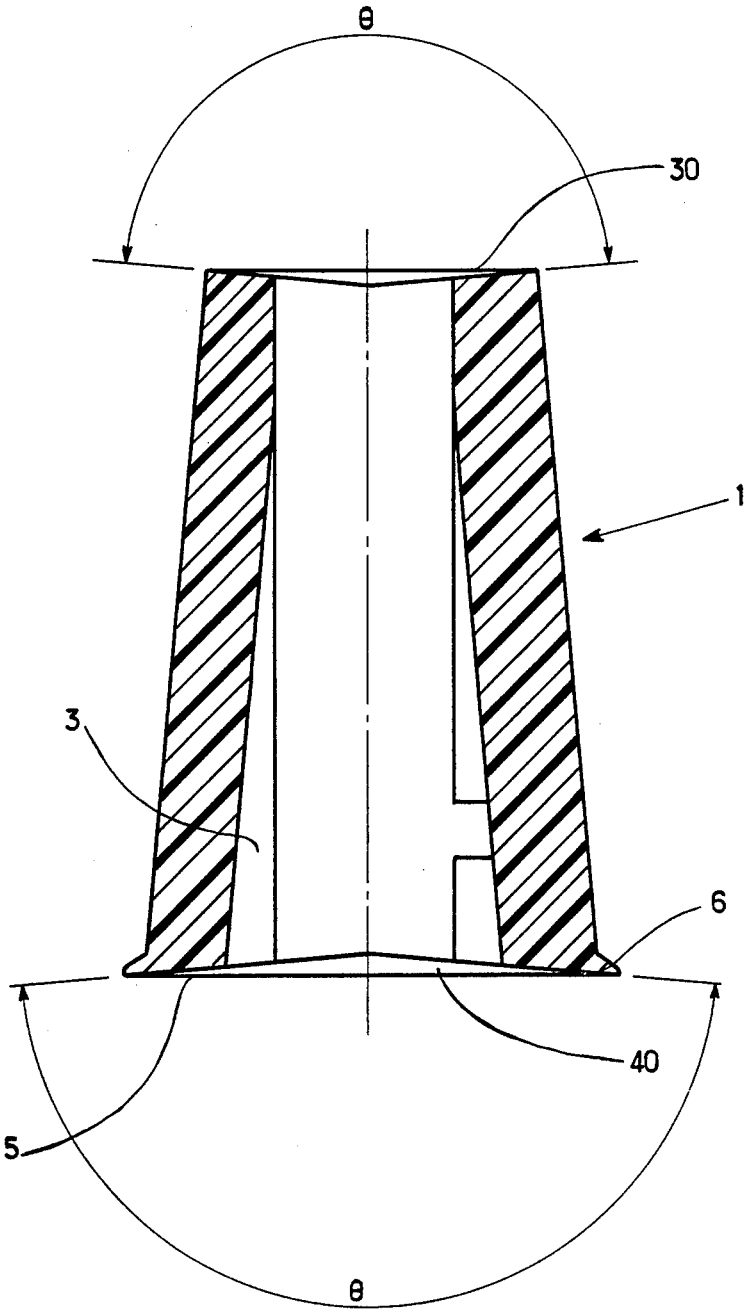
FIG. 1 is a sectional view of a spacing cone according to the present invention.

According to FIG. 1, each cone 1 is made from hollow plastic material and comprises on its inner walls, ribs 3 permitting the centering of cones 1 on the tightening rod during the fitting thereof. In the case shown in the drawings, there are six ribs.

The shape of the ribs is such that they leave a space between them in which the distance A is greater than the distance B, for example, by 1 mm. This arrangement facilitates cleaning of the cone.

To permit the extracting tool 2 to engage within the cones 1, in a manner to be described in greater detail hereinafter, certain ribs 3 are interrupted in the portion 4 of cone 1. For reasons of rigidity, the ribs have a triangular shape and only alternate ribs are interrupted, for example over a length of about 15 mm.

Moreover, the two bases 30 and 40 of cone 1 are not planar and instead each is formed by a very flat cone having an apex angle $\theta$, the top of which is turned towards the inside of cone 1.

In addition, and to avoid the edges 5 of the large ends of the cone from being damaged and to facilitate the extraction of the cones, not retained by cement extending the damaged portions, a wear-preventing flange 6 is moulded around the large base of each cone 1.

Figure 2:
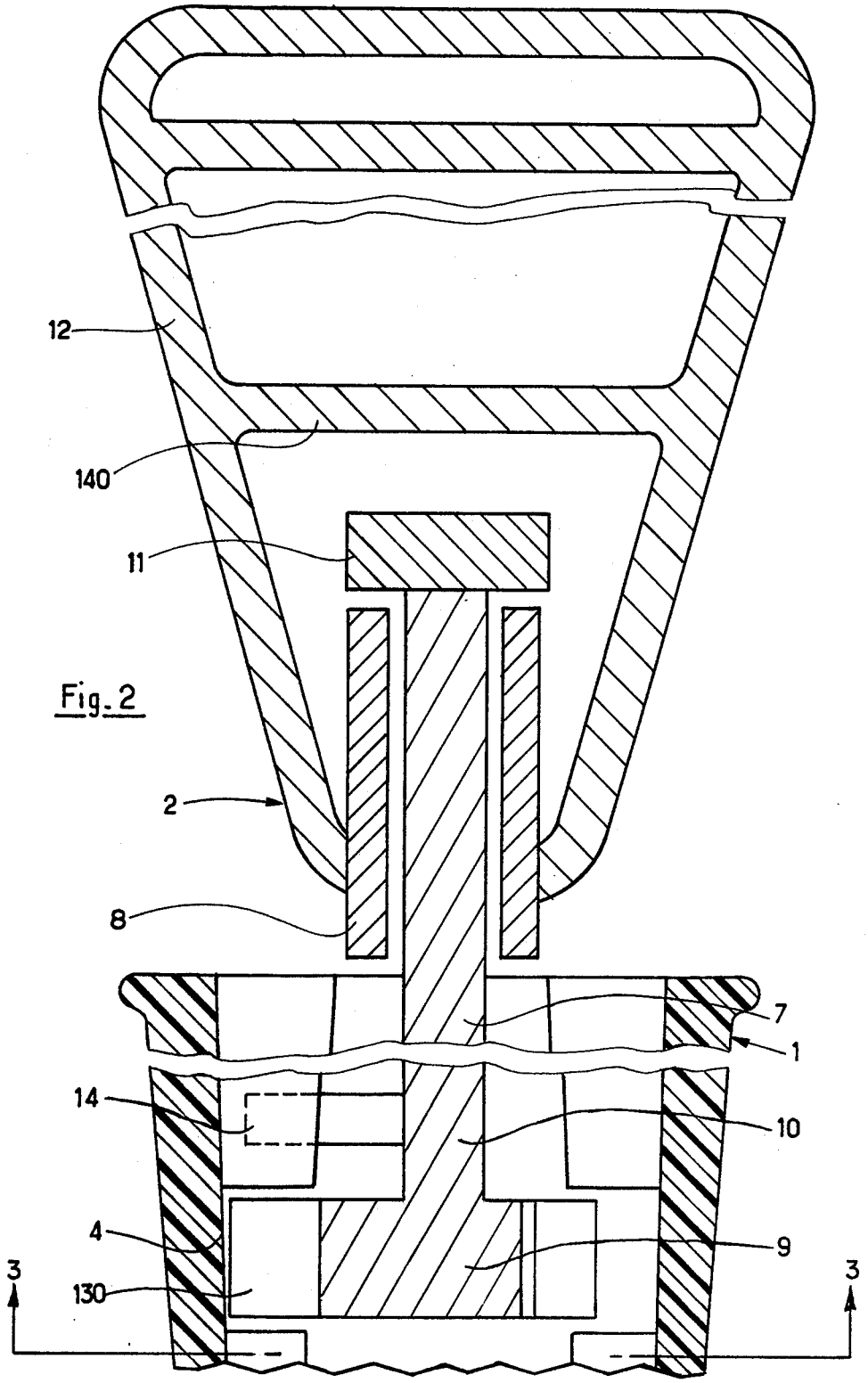
FIG. 2 is a fragmentary sectional view of a cone and extracting tool taken along line 2—2 of FIG. 3.
Figure 3:
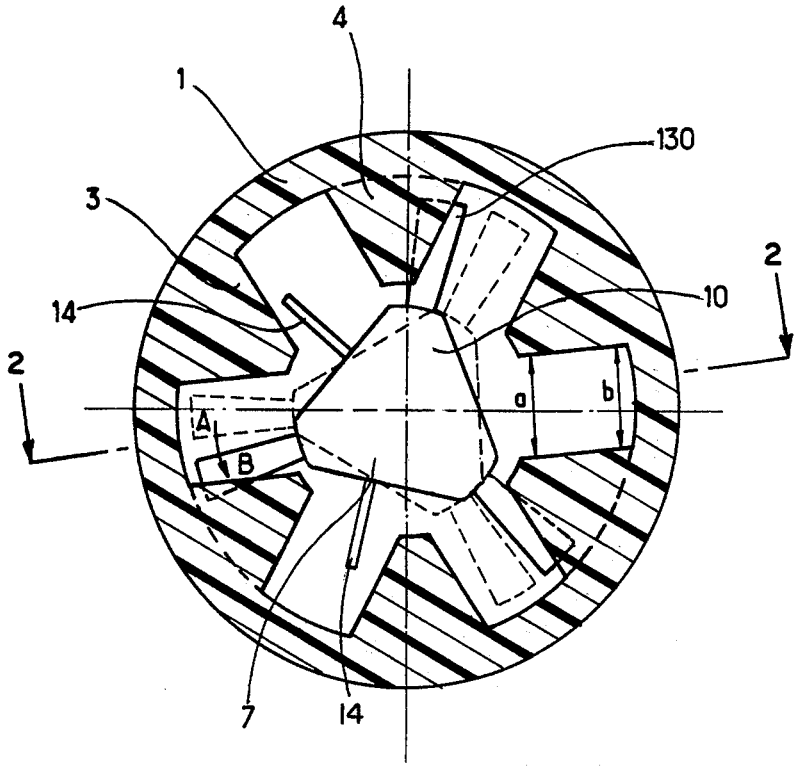
FIG. 3 is a sectional view taken laong line 3—3 of FIG. 2.

According to FIGS. 2 and 3, the extracting tools 2 comprise an introduction rod 7 and a tube 8, movable relative to said introduction rod 7.

Introduction rod 7 has an extraction head 9 which is firstly introduced into the hollow portions of cones 1 and a rod 10 attached to one end to the head 9 and at the opposite end to an abutment 11.

Tube 8 can move along rod 10, but its movement is limited on the one hand by the extraction head 9 and on the other by the abutment 11. Tube 8 can slide along rod 10, with its movement limited by the extraction head 9 and by the abutment 11. A handle 12 mounted on tube 8 is sufficiently heavy to extract the cone when the handle is pulled back and the tube impacts the abutment 11. The extraction head 9 has cutouts 130 which are complementary to the ribs 3 of cone 1. To increase rigidity of cone 1 and simplify the extractor, only alternate ribs are used; consequently, the extraction head 9 has only three cutouts 130. Two stop pins 14 extend diametrically from opposite sides of rod 10 and abut the ribs 3 when the extracting tool 2 is rotated to the desired position relative to cone 1 as shown in FIGS. 2 and 3.

In order to be able to operate the extractor with one hand, the extraction head 9 and rod 10 to which it is fixed must not rotate relative to handle 12. The introduction rod 7 and tube 8 which slides thereon have therefore a non-cylindrical cross-section.

Handle 12 has a stop 140 which limits the displacement of rod 10 during the introduction of the extractor into cone 1.

The method of introducing extractors 2 into cones 1 will be described hereinafter.

The extractor 2 is firstly introduced and then forced into cone 1, in such a way that the cutouts 130 of extraction head 9 slide between ribs 3, as shown in FIG. 3 by the position A in dotted lines. When the cutouts 130 face positions 4 where the ribs are interrupted, handle 12 is turned in accordance with the arrow, so that the cutout 130 assumes the position B in which the pins 14 strike against ribs 3. When the extractor 2 is in the position B, the user pulls on handle 12 outward to impact abutment. Under the impulse of the shock, the cone is detached from the concrete and is then removed from its location.

Thus, this device makes it possible to very easily remove the cones which are recovered on the extractor and therefore do not fall onto the ground, which prevents any risk of breakage or damage. Consequently, the cones can be reused a large number of times, which significantly reduces their cost.

Figure 4:
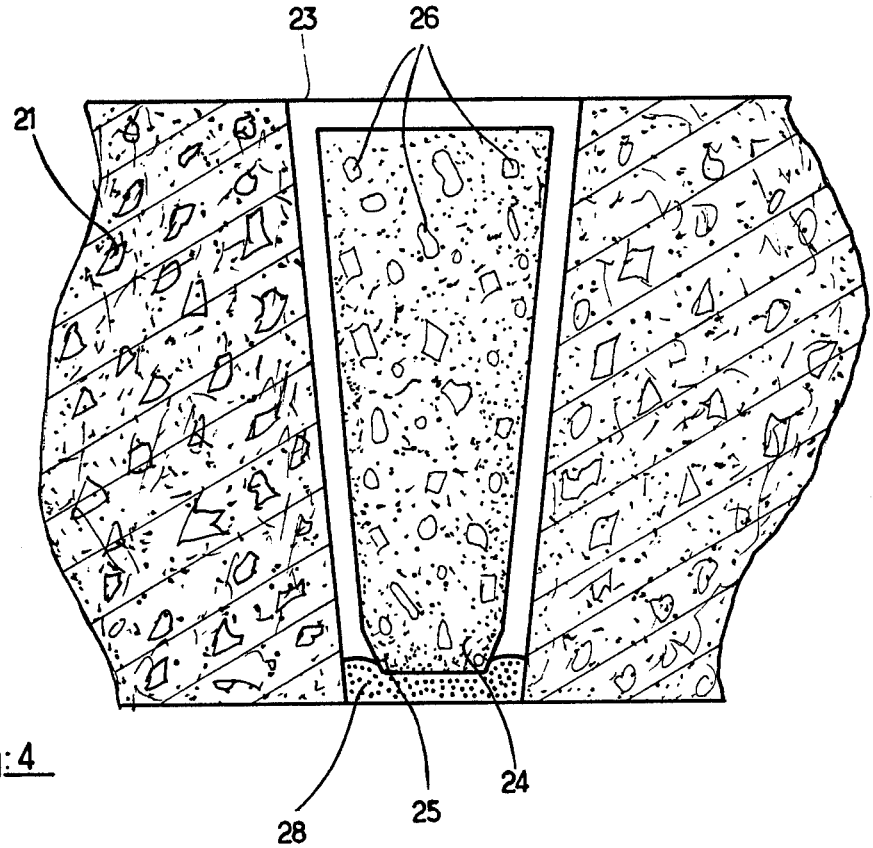
FIG. 4 is a sectional view of a concrete plug positioned in a concrete wall after removal of a spacing plug.

According to FIG. 4, a conical member 24 is introduced into the hole 23 left in the concrete wall 21, when the panel spacing members have been removed.

The length and diameter of members 24 are slightly less than those of the hole 23 to be sealed, in order to more easily bring about the finish of the wall facings by means of special coatings conventionally used on building sites and to leave space for a sealing mortar over the entire cone periphery. Moreover, the end 25 of conical member 24 has a conicity which is roughly double that of the remainder of member 24. This serves to assist the engagement and distribution of the coating used for sealing cone 24 for sealing hole 23, as well as to decompress said coating. Furthermore, the walls of hole 23 are generally very smooth because wall 21 has been vibrated during pouring. Therefore, in order to obtain a better distribution of the coating, the surface of cone 24 can be provided with roughnesses 26.

Figure 5:
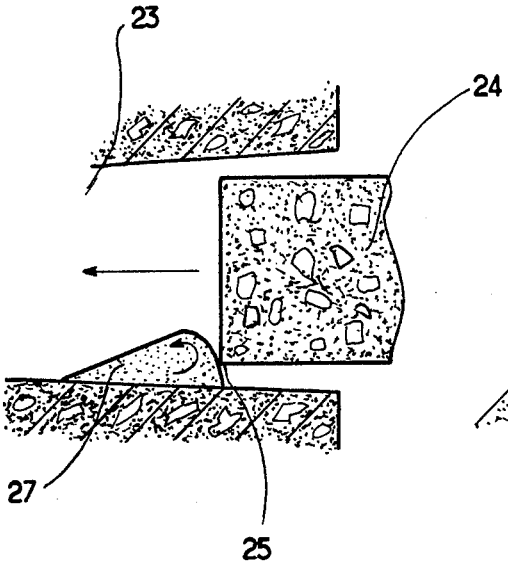
FIG. 5 is a sectional view of a concrete plug inserted into a hole to be sealed in the case where the taper of its small end is not increased.
Figure 6:
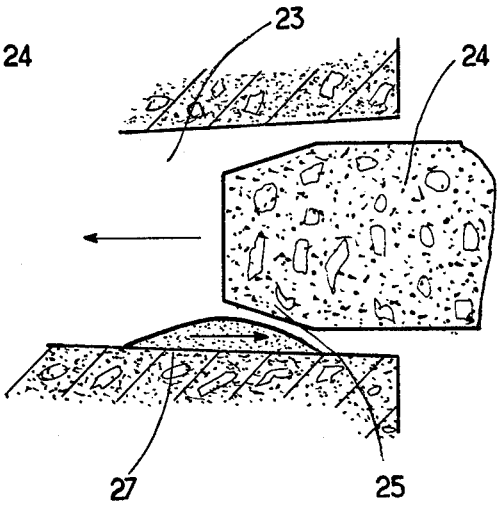
FIG. 6 is a sectional view similar to FIG. 5 whereof its small end is increased.

FIGS. 5 and 6 show the distributing of the coating 27 on commencing the introduction of member 24 into hole 23.

In the case of FIG. 5, the conicity of the end 25 of conical member 24 is not increased and therefore coating 27 cannot be uniformly distributed along the walls of hole 23. It is in fact pushed towards the base of hole 23 where it agglomerates as a mass.

However, in the case of FIG. 6, the increase in the conicity of the end 25 of member 24 makes it possible for coating 27 to be uniformly distributed along the walls of hole 23.

It is easy to see that when members 24 are used, the sealing of the holes left by the panel spacing cones is very simple. Thus, it is merely necessary to place the coating in the holes 23 to be sealed, without any effort being made to uniformly distribute this coating along the hole. Then, the cones 24 are introduced into the hole 23 by their small base, whilst permitting them to turn on themselves, which uniformly distributes the coating 27 over the walls of the hole 23, after which it is merely necessary to drive in cone 24 by means of a hammer and then finish the wall facings with special coatings.

According to FIG. 4, the small base 25 of conical member 24 can be surrounded by a sealing product 28 which ensures the plastic sealing of the assembly.

From the foregoing detailed description, it will be evident that there are a number of changes, adaptations and modifications of the present invention which come within the province of those skilled in the art. However, it is intended that all such variations not departing from the spirit of the invention be considered as within the scope thereof and as limited solely by the appended claims.

I claim:

1. A spacing device to be held in position between two form panels by a conventional tightening rod extending between the panels for ensuring the proper spacing of the form panels during the pouring and curing of concrete walls comprising a body member in the shape of a frustum of a cone having a larger base and a smaller base, said body member having an outwardly extending flange around the larger base and a bore extending through the center of the body member with the bore opening into the centers of the bases and sized to fit closely around a tightening rod when the tightening rod is inserted therethrough, said larger and smaller bases spaced apart by a distance equal to the desired thickness of concrete walls to be poured and said body member having an outer wall provided with inwardly directed longitudinal ribs with at least two continuous longitudinal ribs which create said bore to permit the centering of the device on a tightening rod during the installation thereof between the panels and wherein at least one rib is interrupted to permit the engagement of an extracting tool thereby providing a strong spacing device which accurately spaces the form panels, remains properly aligned with the form panels and the tightening rod during installation and is easily removed from one side of the wall after the form panels have been removed.

2. A spacing device according to claim 1 wherein every alternate rib is interrupted.

3. A spacing device to be held in position between two form panels by a conventional tightening rod extending between the panels for ensuring the proper spacing of the form panels during the pouring and curing of concrete walls comprising a body member in the shape of a frustum of a cone having a larger base and a smaller base, said body member having an outwardly extending flange around the larger base and a bore extending through the center of the body member with the bore opening into the centers of the bases and sized to fit closely around a tightening rod when the tightening rod is inserted therethrough, said larger and smaller bases being spaced apart by a distance equal to one-half the desired thickness of concrete walls to be poured, said spacing device can be installed in pairs on a tightening rod with the smaller bases adjacent one another and the larger bases contacting the form panels and said body member having an outer wall provided with inwardly directed longitudinal ribs with at least two continuous longitudinal ribs which create said bore to permit the centering of the device during the installation thereof between the panels and wherein at least one rib is interrupted to permit the engagement of an extracting tool thereby providing a spacing device which accurately spaces the form panels, remains properly aligned with the form panels and tightening rod during installation and is easily removed from the wall after the form panels have been removed.

4. A spacing device according to claim 3 wherein every alternate rib is interrupted.

* * * * *